US006428110B1

(12) United States Patent
Ritchey et al.

(10) Patent No.: US 6,428,110 B1
(45) Date of Patent: Aug. 6, 2002

(54) CUTTING TOOL RETAINER

(75) Inventors: Cary D. Ritchey, Curryville; Stephen P. Stiffler, New Enterprise, both of PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/639,783

(22) Filed: Aug. 16, 2000

(51) Int. Cl.[7] ..... E21C 35/19; E21C 35/197

(52) U.S. Cl. ..... 299/107; 299/113; 299/102; 37/458; 24/673

(58) Field of Search ..... 299/102, 113, 299/109, 104, 107; 37/458, 456, 459; 24/673

(56) References Cited

U.S. PATENT DOCUMENTS

| | | | | |
|---|---|---|---|---|
| RE18,144 | E | 8/1931 | Heirmann | |
| 3,690,728 | A | 9/1972 | Krekeler | |
| 3,752,515 | A * | 8/1973 | Oaks et al. | 287/52 R |
| 3,952,433 | A | 4/1976 | Heinold et al. | |
| 3,957,307 | A | 5/1976 | Varda | |
| 4,247,147 | A * | 1/1981 | Rettkowski | 299/10 |
| 4,404,760 | A | 9/1983 | Hahn et al. | |
| 4,505,058 | A | 3/1985 | Peterson | |
| 4,650,254 | A | 3/1987 | Wechner | |
| 4,684,176 | A | 8/1987 | Den Besten et al. | |
| 4,733,987 | A | 3/1988 | Tomlinson et al. | |
| 4,763,956 | A | 8/1988 | Emmerich | |
| 4,883,129 | A | 11/1989 | Lonn et al. | |
| 5,011,229 | A | 4/1991 | O'Neil et al. | |
| 5,529,384 | A | 6/1996 | Ojanen et al. | |
| 5,690,393 | A | 11/1997 | Massa et al. | |
| 5,720,528 | A | 2/1998 | Ritchey | |
| 6,070,945 | A | 6/2000 | Ritchey et al. | |

FOREIGN PATENT DOCUMENTS

| | | | |
|---|---|---|---|
| DE | 2716177 | * | 10/1977 |
| GB | 2 079 350 A | | 1/1982 |
| PL | 172654 | * | 9/1995 |

OTHER PUBLICATIONS

Kennametal, Inc. Brochure entitled "Construction Tools" 1997, p. 1–20.

Kennametal, Inc. Brochure entitled "Kennametal Mining Products" 1996, p. 11.

Rotor Clip Company, Inc.'s Catalog and Engineering Manual entitled "Rotor Clip Retaining Rings " 1985–91.

Kennametal, Inc. Brochure entitled "Chain and Wheel Trenching Tools" 1999, p. 20.

* cited by examiner

*Primary Examiner*—David Bagnell
*Assistant Examiner*—Daniel P Stephenson
(74) *Attorney, Agent, or Firm*—Kevin P. Weldon

(57) ABSTRACT

A retainer, adapted to engage a recess in a cutting tool for securing the cutting tool to a support block, includes a retainer body having a main portion with first and second ends. The main portion defines a continuous shear zone having first and second ends. The retainer body further includes a protruding portion disposed between the ends of the continuous shear zone and spaced away from the ends of the main portion. The protruding portion extends radially from the main portion and is adapted to overlap the support block when the retainer is engaging the recess.

36 Claims, 4 Drawing Sheets

Fig. 2
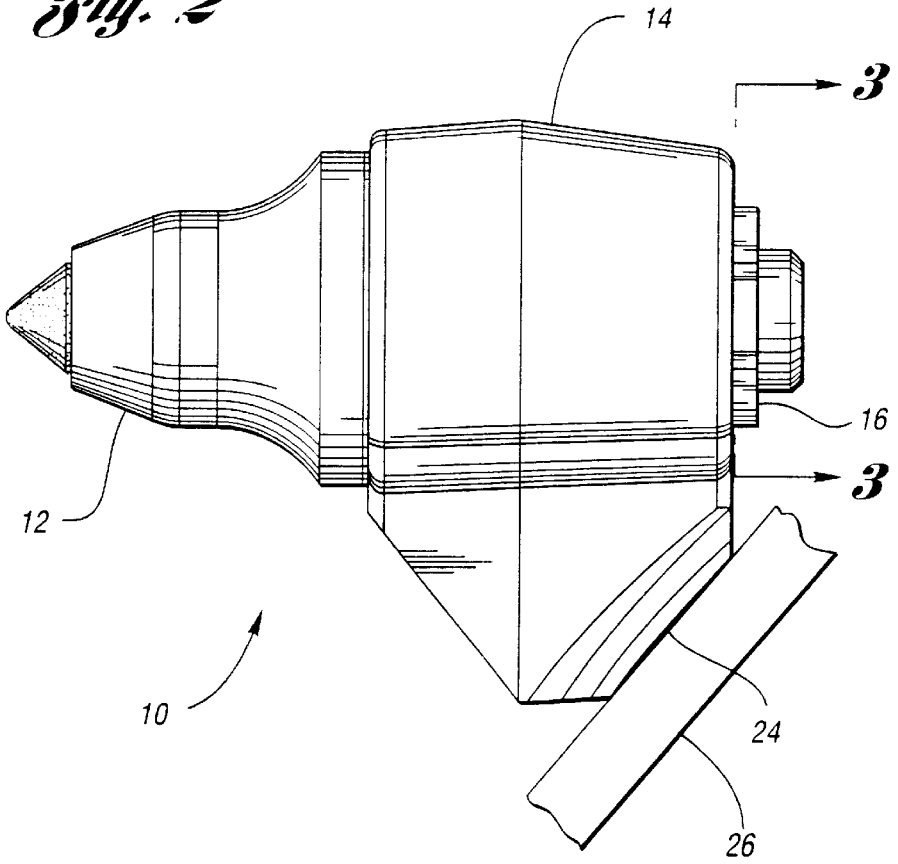
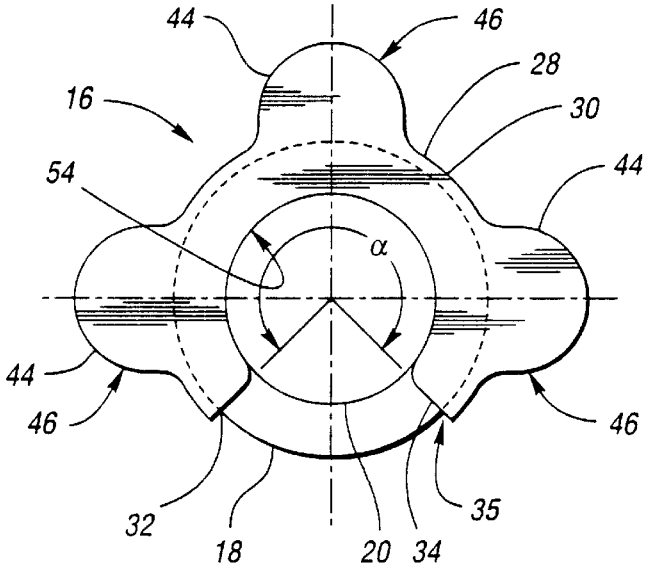
Fig. 3

CUTTING TOOL RETAINER

TECHNICAL FIELD

The invention relates to a retainer for retaining a cutting tool in a support block.

BACKGROUND ART

Cutting tool assemblies for such applications as mining or road milling typically comprise a cutting tool, sometimes referred to as a cutting pick, rotatably mounted within a support block. The support block in turn is mounted onto a drum or other body, typically by welding, which in turn is driven by a suitable drive means. When a number of such support blocks carrying cutting tools are mounted onto a drum, and the drum is driven, the cutting tools will engage and break up the material sought to be mined or removed. The general operation of such a mining or construction machine is well known in the art.

Various retainers have been proposed or used to mount a cutting tool, rotatably or otherwise, within a support block. For example, U.S. Pat. No. 4,505,058 to Peterson shows a retainer having two legs. This retainer is intended to be used with a support block having a recess with specially configured sidewalls which cooperate with the bends in the retainer legs to hold the retainer in place. More specifically, the sidewalls of the recess include projections to limit movement of the retainer with respect to the support block. This type of retainer is relatively difficult to move in order to disengage the retainer from the cutting tool in that a screwdriver or other similar object must be inserted into the recess and under the top of the retainer in order to pry and move the retainer. Like other similar retainers relying on prongs, the two legs of this retainer provide only four shear zones or areas where the retainer overlaps both the cutting tool and the support block. Because these shear zones prevent disengagement of the cutting tool from the support block, the number of such shear zones relates to the strength and durability of the retainer.

U.S. Pat. No. 4,883,129 to Lonn et al. shows another retainer which overlaps a cutting tool shank and a support block along substantially the entire length of the retainer. Consequently, the retainer provides a single, continuous shear zone along its entire length. However, this type of retainer is difficult to install and remove. More specifically, this retainer does not provide any slots or openings which may be grasped or which may receive a device for prying the retainer from the cutting tool shank. Furthermore, because the portion of the retainer that overlaps the support block is relatively narrow, this type of retainer does not sufficiently secure the cutting tool within the support block over an extended period of time.

DISCLOSURE OF INVENTION

The invention addresses the shortcomings of the prior art by providing an improved retainer that is adapted to engage a recess in a cutting tool for securing the cutting tool to a support block.

In one embodiment of the invention, the retainer includes a retainer body having a main portion with first and second ends. The main portion defines a continuous shear zone having first and second ends. The retainer body further includes a protruding portion disposed between the ends of the continuous shear zone and spaced away from the ends of the main portion. The protruding portion extends radially from the main portion and is adapted to overlap the support block when the retainer is engaging the recess.

The protruding portion preferably has an outer surface that is engageable with an installation/removal device for installing the retainer in the recess and for removing the retainer from the recess. Advantageously, with such a configuration, the retainer may be easily installed on and removed from the cutting tool.

The protruding portion is preferably a solid projection, such as a lobe, so that the protruding portion is a rigid extension of the retainer body. Alternatively, the protruding portion may have any suitable configuration.

Furthermore, the retainer body may include additional protruding portions. For example, the retainer body may include at least two or at least three protruding portions extending radially from the main portion. Such additional protruding portions may be used to improve contact between the retainer body and an installation/removal device.

Preferably, the continuous shear zone extends through an angle of at least one hundred eighty degrees. With such a configuration, the retainer has significant strength and durability characteristics.

The main portion may also form part of a helix. With such a configuration, movement of the cutting tool with respect to the support block can be reduced or eliminated.

In another embodiment of the invention, the retainer includes a retainer body having a main portion that defines a continuous shear zone, and at least three protruding portions extending radially from the main portion. Each protruding portion is adapted to overlap the support block when the retainer is engaging the recess.

In yet another embodiment of the invention, the retainer includes a retainer body having first and second ends, and a protruding portion disposed between the ends and spaced away from the ends. The protruding portion has a width and defines a continuous shear zone along the width.

Furthermore, the retainer described above may be provided with at least two additional protruding portions disposed between the ends of the retainer body. Preferably each additional protruding portion also defines a continuous shear zone. With such a configuration, strength and durability of the retainer is improved.

While an exemplary retainer is illustrated and disclosed, such disclosure should not be construed to limit the claims. It is anticipated that various modifications and alternative designs may be made without departing from the scope of the invention.

BRIEF DESCRIPTION OF DRAWINGS

FIG. 2 is a side view of the cutting tool assembly;

FIG. 3 is a cross-sectional view taken along line 3—3 of FIG. 2 in the direction of the arrows, and showing the retainer and a shank of the cutting tool;

BEST MODES FOR CARRYING OUT THE INVENTION

Figure 1:
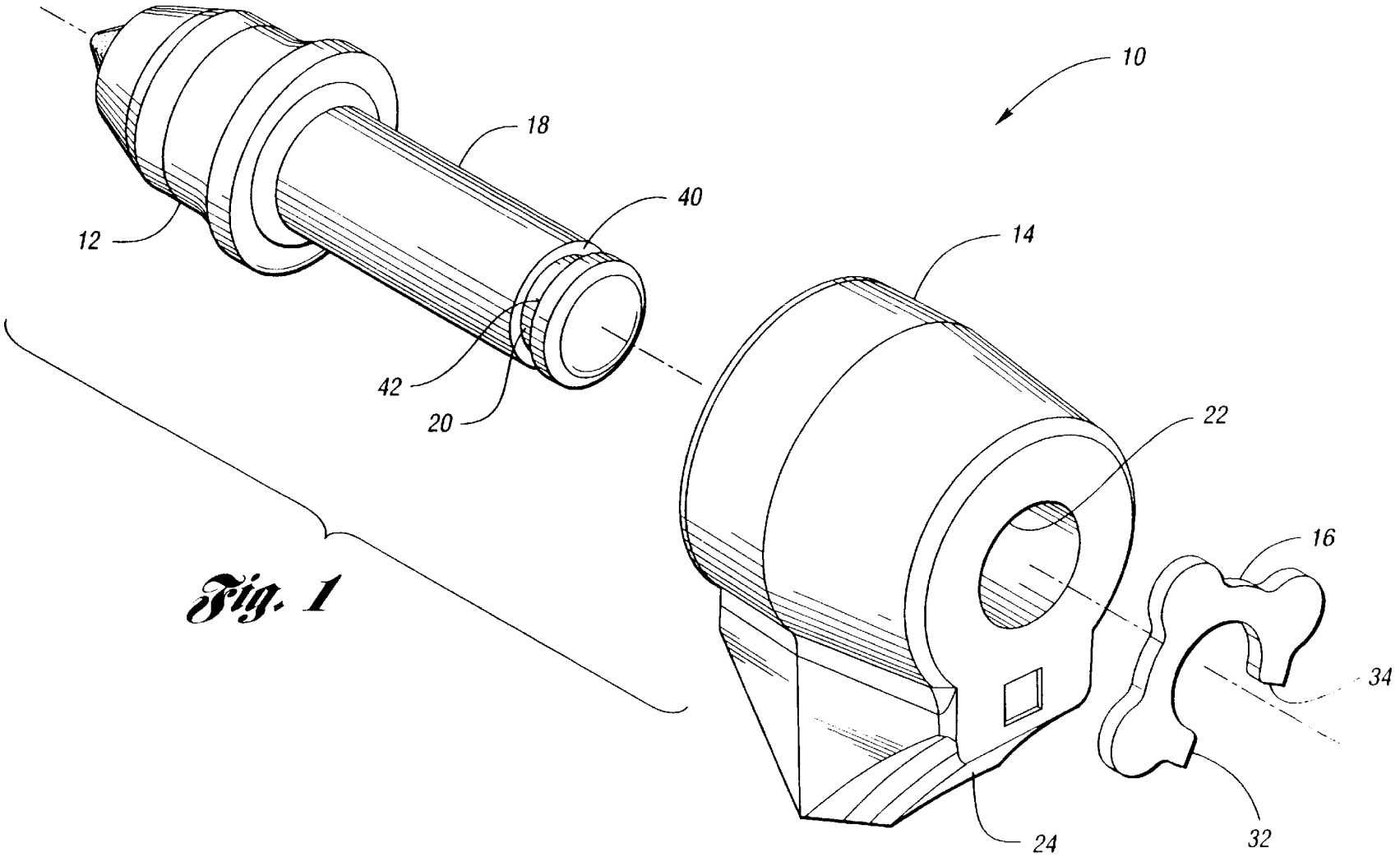
FIG. 1 is an exploded perspective view of a cutting tool assembly including a cutting tool, a support block and one embodiment of the retainer of the invention.

Referring to the drawings, FIGS. 1 and 2 show a cutting tool assembly 10 including a cutting tool 12, a support block 14 and a retainer 16 according to the invention. The cutting tool 12 has a preferably cylindrical shank 18 with an annular groove or recess 20 for receiving the retainer 16. The support block 14 has a preferably cylindrical bore 22 for receiving the shank 18, and a base 24 that can be welded or otherwise attached to a track pad 26 of a trenching machine (not shown). When the track pad 26 is driven by the trenching machine, the cutting tool 12 will engage and break up material sought to be mined or removed. Alternatively, the support block 14 may be welded or otherwise attached to a drum (not shown) or any other suitable body.

Figure 4:
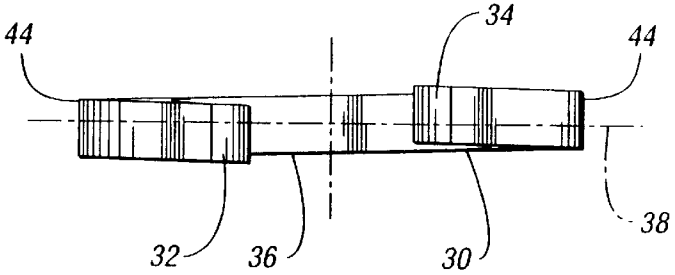
FIG. 4 is a side view of the retainer.

Referring to FIGS. 3 and 4, the retainer 16 has a retainer body 28. The retainer body 28 has a main portion such as a curved portion 30 having first and second ends 32 and 34, respectively. The curved portion 30 defines an arc preferably extending through an angle of at least one hundred eighty degrees. In the embodiment shown in FIGS. 3 and 4, the curved portion 30 defines an arc extending through an angle a of two hundred seventy degrees.

The curved portion 30 also defines a continuous shear zone 35 preferably, but not necessarily, along the entire length of the arc. The term "shear zone" as used in this application means a portion of the retainer body 28 that overlaps both the shank 18 and the support block 14 when the retainer 16 is installed on the shank 18. Preferably, the continuous shear zone 35 extends through an angle in the range of thirty to three hundred degrees. More preferably, the continuous shear zone 35 extends through an angle of at least one hundred eighty degrees, and has first and second ends that are the same as or coextensive with the first and second ends 32 and 34, respectively, of the curved portion 30. In the embodiment shown in FIGS. 3 and 4, the continuous shear zone 35 extends through the angle a of two hundred seventy degrees, and has first and second ends that are the same as or coextensive with the first and second ends 32 and 34, respectively, of the curved portion 30.

Alternatively, one or both ends 32 and 34 of the curved portion 30 may extend beyond one or both ends, respectively, of the continuous shear zone 35. For example, the curved portion 30 may taper toward the ends 32 and 34, such that the curved portion 30 does not define a shear zone proximate either of the ends 32 and 34.

Furthermore, the curved portion 30 preferably forms part of a helix. For example, as shown in FIG. 4, a central section 36 of the curved portion 30 is preferably on a slant with respect to an axis such as a horizontal line 38. As a result, the first end 32 preferably extends below the central section 36, and the second end 34 preferably extends above the central section 36. Referring to FIG. 1, when the retainer 16 is forced into the recess 20, the first end 32 will bear against a first wall 40 defining the recess 20, and the second end 34 will bear against a second wall 42 defining the recess 20. With such a configuration, movement of the cutting tool 12 relative to the support block 14, such as axial jiggling of the cutting tool 12, can be reduced or eliminated. Alternatively, the curved portion 30 may be planar.

Figure 5:
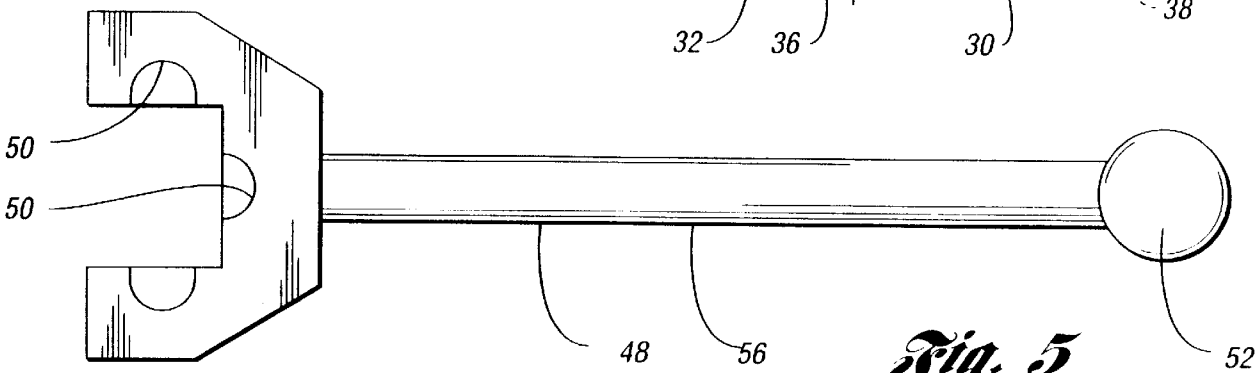
FIG. 5 is a top view of an installation/removal device or puller for installing and removing the retainer.
Figure 6:
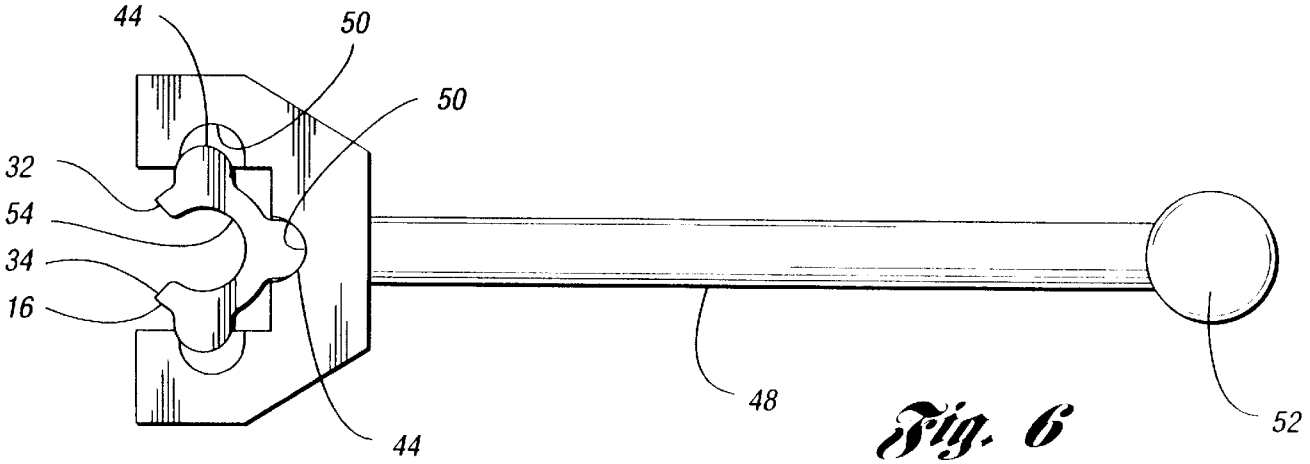
FIG. 6 is a top view of the puller with the retainer positioned on the puller.
Figure 7:
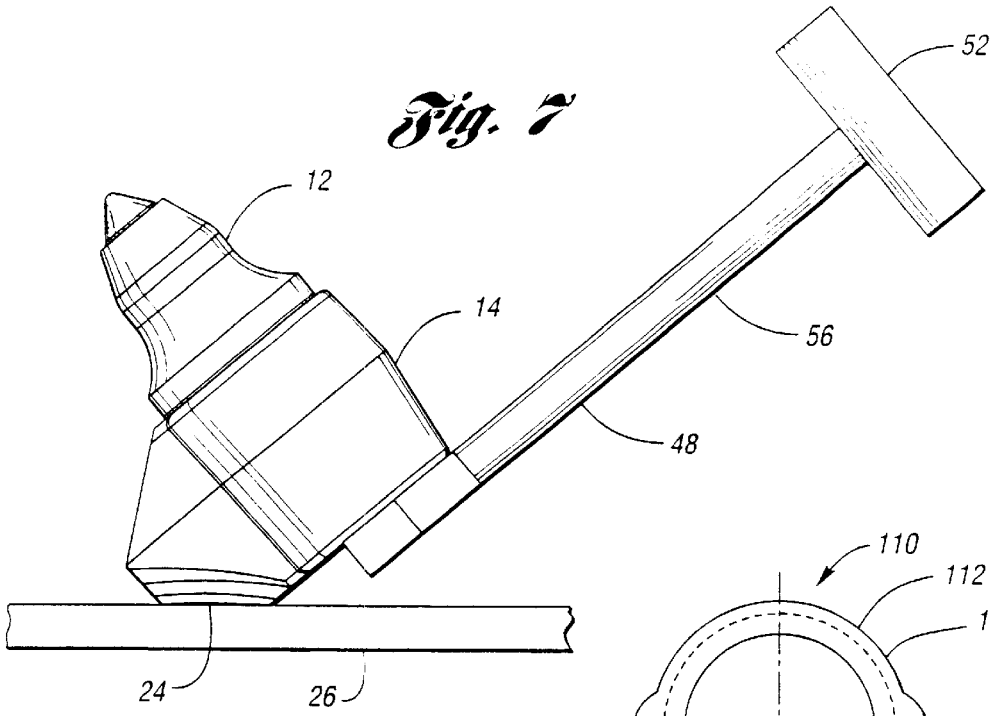
FIG. 7 is a side view of the cutting tool assembly and the puller positioned adjacent the support block.

Returning to FIG. 3, the retainer body 28 further includes one or more protruding portions 44 that extend radially from the curved portion 30 and overlap the support block 14 when the retainer 16 is engaging the recess 20. While the protruding portions 44 may have any suitable configuration, each protruding portion 44 is preferably a solid projection such as a lobe. Each protruding portion 44 also has an axially extending outer surface 46 that is engageable with an installation/removal device such as a puller 48, shown in FIG. 5. The puller 48 has multiple recesses or indentations 50, and each indentation 50 is configured to receive a particular protruding portion 44.

While the retainer 16 may be formed in any suitable manner, the retainer is preferably stamped from a sheet of resilient high carbon spring steel having a thickness in the range of 0.09 to 0.22 inches. A suitable steel is No. 1050 to 1070 carbon steel having a hardness value preferably in the range of 38 to 48 Rc. Furthermore, retainer 16 preferably, but not necessarily, has a width greater than or equal to the thickness of the retainer 16 so that the features of the retainer 16 can be accurately formed by stamping. Alternatively, the retainer 16 may be formed from any suitable material.

Referring to FIGS. 1, 3, 6 and 7, in order to use the retainer 16 of this invention, the cylindrical shank 18 of the cutting tool 12 is inserted into the bore 22 of the support block 14 such that the recess 20 is exposed. The retainer 16 is then positioned on the puller 48 such that each protruding portion 44 extends into a particular indentation 50. The puller 48 is then positioned adjacent the support block 14 so that the retainer 16 is sandwiched between the puller 48 and the support block 14, and so that the ends 32 and 34 of the retainer 16 are disposed in the recess 20. Next, a radial force is applied to a handle 52 of the puller 48 so as to press the retainer 16 onto the recess 20. When the retainer 16 is pressed onto the recess 20, the ends 32 and 34 will bend outwardly from each other so as to enable the retainer 16 to snap into place. Furthermore, when the retainer 16 is pressed onto the recess 20, outer surfaces 46 of the protruding portions 44 disposed proximate the ends 32 and 34 preferably engage corresponding recesses 50 of the puller 48. When the retainer 16 is properly installed on the shank 18, an inner surface 54 of the curved portion 30 bears upon the recess 20 to prevent further transverse movement of the retainer 16 relative to the shank 18. Alternatively, the retainer 16 may be installed on the shank 18 in any suitable manner.

To remove the retainer 16, the puller 48 is again positioned adjacent the support block 14 so that the retainer 16 is sandwiched between the puller 48 and the support block 14, and so that each protruding portion 44 extends into a particular indentation 50. Next, the puller 48 may be rotated toward the track pad 26, or other suitable surface, until a portion of the puller 48, such as a rod 56, engages the track pad 26. Further rotation of the puller 48 against the track pad 26, or other suitable surface, enables the puller 48 to pry the retainer 16 from the recess 20. Alternatively, the retainer 16 may be removed from the recess 20 in any suitable manner. Fore example, one of the protruding portions 44 may be grasped by a suitable tool, such as a pair pliers, so as to pull the retainer 16 away from the recess 20.

Because the continuous shear zone 35 preferably extends the entire length of the curved portion 30, the retainer 16 has significant strength and durability characteristics. Furthermore, the protruding portions 44 enable the retainer 16 to be easily installed on and removed from the shank 18.

Figure 8:
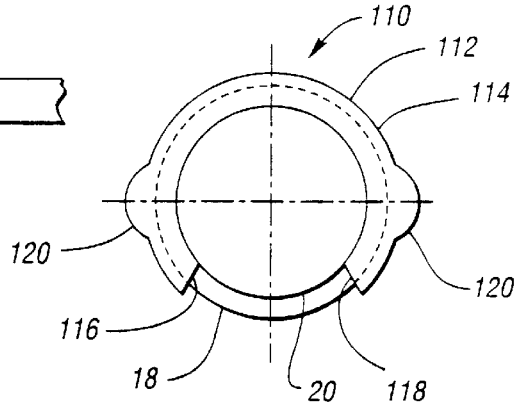
FIG. 8 is a cross-sectional view similar to FIG. 3 showing a second embodiment of the retainer of this invention mounted on the shank of a cutting tool.
Figure 9:
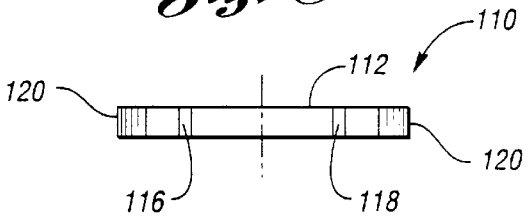
FIG. 9 is a side view of the second embodiment of the retainer.

FIGS. 8 and 9 show a second embodiment 110 of the retainer according to the invention. The retainer 110 has a retainer body 112 including a main portion, such as a curved portion 114, having first and second ends 116 and 118, respectively. Similar to the curved portion 30 of the retainer 10, the curved portion 114 preferably defines an arc and a continuous shear zone along the arc from end 116 to end 118. The retainer body 112 further includes one or more protruding portions 120, similar to the protruding portions 44, that extend radially beyond the curved portion 114 and overlap the support block 14 when the retainer 110 is engaging the recess 20. Moreover, the curved portion 114 is preferably planar, and the protruding portions 120 are co-planar with the curved portion 114.

Figure 10:
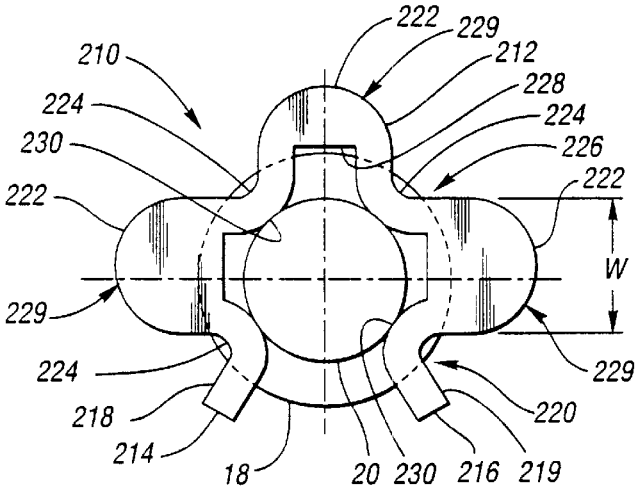
FIG. 10 is a cross-sectional view similar to FIG. 3 showing a third embodiment of the retainer of this invention mounted on the shank of a cutting tool.

FIG. 10 shows a third embodiment 210 of the retainer according to the invention. The retainer 210 has a retainer body 212. The retainer body 212 has first and second ends 214 and 216, respectively, having end portions 218 and 219, respectively. The end portions 218 and 219 are preferably outwardly splayed to facilitate installation of the retainer 210 onto the cutting tool shank 18. At least one of the end portions 218 and 219 preferably extends over both the shank 18 and the support block 14, thereby defining at least one discrete shear zone 220.

The retainer body 212 further includes a plurality of protruding portions 222 and a plurality of curved sections 224 disposed between and formed integral with the end portions 218 and 219. The protruding portions 222 protrude beyond the diameter of the shank 18 so as to engage the support block 14 and inhibit removal of the shank 18 from the bore 22. Each protruding portion 222 also preferably defines a continuous shear zone 226 along an entire width W of the protruding portion 222. Preferably, but not necessarily, each protruding portion 222 is configured such that the respective continuous shear zone 226 extends along the circumference of the shank 18, through an angle of thirty to ninety degrees, when the retainer 210 is engaged with the recess 20. Alternatively, one or more of the protruding portions 222 may cooperate with the shank 18 to define a gap 228 that extends radially beyond the shank 18.

Furthermore, each protruding portion 222 has an axially extending outer surface 229 that is engageable with an installation/removal device such as the puller 48. Thus, the retainer 210 may be installed on and removed from the recess 20 in a manner similar to the retainer 16.

The curved sections 224 define engaging portions 230 that reside within and engage the recess 20. The engaging portions 230 inhibit further radial movement of the retainer 210 once the retainer 210 is properly installed on the shank 18. While any suitable configuration may be used, in the embodiment shown in FIG. 10, the engaging portions 230 are generally U-shaped.

Because the retainer 210 preferably includes two discrete shear zones 220, and three continuous shear zones 226, the retainer 210 also has significant strength and durability characteristics. Furthermore, like the protruding portions 44, the protruding portions 222 enable the retainer 210 to be easily installed on and removed from the shank 18.

While embodiments of the invention have been illustrated and described, it is not intended that these embodiments illustrate and describe all possible forms of the invention. It should be understood that the words used in the specification are words of description rather than limitation, and various changes may be made without departing from the spirit and scope of the invention.

What is claimed is:

1. A retainer for securing a cutting tool to a support block, the cutting tool having a shank with a recess, the retainer being adapted to engage the recess, the retainer comprising:

a retainer body including a main portion having first and second ends and defining a continuous shear zone having first and second ends, the retainer body further including a protruding portion disposed between the ends of the continuous shear zone and spaced away from the ends of the main portion, the protruding portion extending radially from the main portion and being adapted to overlap the support block when the retainer is engaging the recess.

2. The retainer of claim 1 wherein the first and second ends of the continuous shear zone are coextensive with the first and second ends, respectively, of the main portion.

3. The retainer of claim 1 wherein the protruding portion has an axially extending outer surface that is engageable with a removal device for removing the retainer from the recess.

4. The retainer of claim 1 wherein the protruding portion is a solid projection.

5. The retainer of claim 1 wherein the continuous shear zone extends through an angle of at least one hundred eighty degrees.

6. The retainer of claim 1 wherein the continuous shear zone extends through an angle of at least two hundred seventy degrees.

7. The retainer of claim 1 wherein the main portion forms part of a helix.

8. The retainer of claim 1 wherein the retainer body has at least two protruding portions extending radially from the main portion, the protruding portions being adapted to overlap the support block when the retainer is engaging the recess.

9. The retainer of claim 1 wherein the retainer body has at least three protruding portions extending radially from the main portion, the protruding portions being adapted to overlap the support block when the retainer is engaging the recess.

10. The retainer of claim 9 wherein each protruding portion is a solid projection.

11. The retainer of claim 9 wherein the protruding portions are coplanar with the main portion.

12. The retainer of claim 9 wherein one protruding portion is noncoplanar with another protruding portion.

13. A retainer for securing a cutting tool to a support block, the cutting tool having a shank with a recess, the retainer being adapted to engage the recess, the retainer comprising:

a retainer body including a curved portion that forms part of a helix and defines a continuous shear zone extending through an angle of at least one hundred eighty degrees, the retainer body further including at least three solid projections extending radially from the curved portion, the projections being adapted to overlap the support block when the retainer is engaging the recess, at least one of the protruding portions having an axially extending outer surface engageable with a removal device for removing the retainer from the recess.

14. A cutting tool assembly comprising:

a cutting tool having a shank, the shank having a recess;

a support block having a bore for receiving the shank; and a retainer removably disposed about the recess for securing the cutting tool to the support block, the retainer including a main portion having first and second ends and defining a continuous shear zone having first and second ends, the retainer further including a protruding portion disposed between the ends of the continuous shear zone and spaced away from the ends of the main portion, the protruding portion extending radially from the main portion such that the protruding portion overlaps the support block when the retainer is engaging the recess.

15. The cutting tool assembly of claim 14 wherein the first and second ends of the continuous shear zone are coextensive with the first and second ends, respectively, of the main portion.

16. The cutting tool assembly of claim 14 wherein the protruding portion has an axially extending outer surface that is engageable with a removal device for removing the retainer from the recess.

17. The cutting tool assembly of claim 14 wherein the protruding portion is a solid projection.

18. The cutting tool assembly of claim 14 wherein the continuous shear zone extends through an angle of at least one hundred eighty degrees.

19. The cutting tool assembly of claim 14 wherein the continuous shear zone extends through an angle of at least two hundred seventy degrees.

20. The cutting tool assembly of claim 14 wherein the main portion forms part of a helix.

21. The cutting tool assembly of claim 14 wherein the retainer includes at least two protruding portions extending radially from the main portion, the protruding portions overlapping the support block when the retainer is engaging the recess.

22. The cutting tool assembly of claim 14 wherein the retainer includes at least three protruding portions extending radially from the main portion, the protruding portions overlapping the support block when the retainer is engaging the recess.

23. The cutting tool assembly of claim 22 wherein each protruding portion is a solid projection.

24. The cutting tool assembly of claim 22 wherein the protruding portions are coplanar with the main portion.

25. The cutting tool assembly of claim 22 wherein one protruding portion is non-coplanar with another protruding portion.

26. A retainer for securing a cutting tool to a support block, the cutting tool having a shank with a recess, the retainer being adapted to engage the recess, the retainer comprising:

a retainer body having a main portion that defines a continuous shear zone, and at least three protruding portions extending radially from the main portion, each protruding portion being adapted to overlap the support block when the retainer is engaging the recess.

27. The retainer of claim 26 wherein each protruding portion has an axially extending outer surface that is engageable with a removal device for removing the retainer from the recess.

28. The retainer of claim 26 wherein each protruding portion is a solid projection.

29. The retainer of claim 26 wherein the continuous shear zone extends at least one hundred eighty degrees.

30. The retainer of claim 26 wherein the main portion forms part of a helix.

31. A retainer for securing a cutting tool to a support block, the cutting tool having a shank with a recess, the retainer being adapted to engage the recess, the retainer comprising:

a retainer body having first and second ends, and a protruding portion disposed between the ends and spaced away from the ends, the protruding portion having a width and defining a continuous shear zone along the width wherein the retainer body includes at least one additional protruding portion disposed between the ends; and wherein said first and second ends each have end portions, at least one of said end portions defines a continuous shear zone.

32. The retainer of claim 31 wherein the retainer body includes at least two additional protruding portions disposed between the ends.

33. The retainer of claim 32 wherein one of the additional protruding portions defines a continuous shear.

34. The retainer of claim 32 wherein each additional protruding portion defines a continuous shear zone.

35. The retainer of claim 34 wherein each continuous shear zone extends through an angle of at least forty-five degrees.

36. A retainer for securing a cutting tool to a support block, the cutting tool having a shank with a recess, the retainer being adapted to engage the recess, the retainer comprising:

a retainer body having first and second ends, and a protruding portion disposed between the ends and spaced away from the ends, the protruding portion having a width and defining a continuous shear zone along the width, wherein the protruding portion has an axially extending outer surface that is engageable with a removal device for removing the retainer from the recess.

* * * * *